United States Patent [19]

Hills et al.

[11] Patent Number: 4,685,564

[45] Date of Patent: Aug. 11, 1987

[54] BLADE-HOLDER MAGAZINE

[75] Inventors: Ivan E. Hills, Kinnelon; George Holmelund, Dover, both of N.J.

[73] Assignee: Hacker Instruments, Inc., Fairfield, N.J.

[21] Appl. No.: 890,647

[22] Filed: Jul. 30, 1986

[51] Int. Cl.[4] ..... D65D 83/10

[52] U.S. Cl. ..... 206/354; 206/341; 206/356; 206/357; 206/468; 206/470

[58] Field of Search ..... 206/354–358, 206/338, 468, 341, 481, 488, 470, 480, 560; 269/254 R, 239

[56] References Cited

U.S. PATENT DOCUMENTS

| | | | |
|---|---|---|---|
| 337,520 | 3/1886 | Richards | 206/338 |
| 1,094,400 | 4/1914 | Burgess | 269/239 |
| 1,288,112 | 12/1918 | Minnis | 269/239 |
| 1,813,686 | 7/1931 | Stetson | 206/354 |
| 2,194,828 | 3/1940 | Greaves | 206/456 |
| 2,601,184 | 6/1952 | Urbain | 206/456 |
| 3,212,688 | 10/1965 | Lane | 269/254 R |
| 3,926,313 | 12/1975 | Winkler | 206/456 |
| 4,285,456 | 8/1987 | Sheng-Wei | 206/338 |

*Primary Examiner*—Stephen Marcus
*Assistant Examiner*—Brenda J. Ehrhardt
*Attorney, Agent, or Firm*—Bernard J. Murphy

[57] ABSTRACT

The magazine comprises a platform upon which, in slidable disposition, are carried a plurality of blade carriers. The carriers are movable sidewise of the platform, and each such carrier defines a recess in which to nest a blade. The carrier recess is formed of a pair of limbs rising from a base, one of the limbs being integral with the base, and the other being pivotably coupled to an end of the base. The limbs have mutually confronting channels formed therein, with springs set therein, for receiving and latching therein a blade. The pivotable lime is so coupled to the base to allow it to slue and open the recess formed of the confronting channels, so as to release a blade held therein, and to accommodate its closure of the recess by its slueing in the opposite direction to latch and hold a blade in the recess.

9 Claims, 4 Drawing Figures

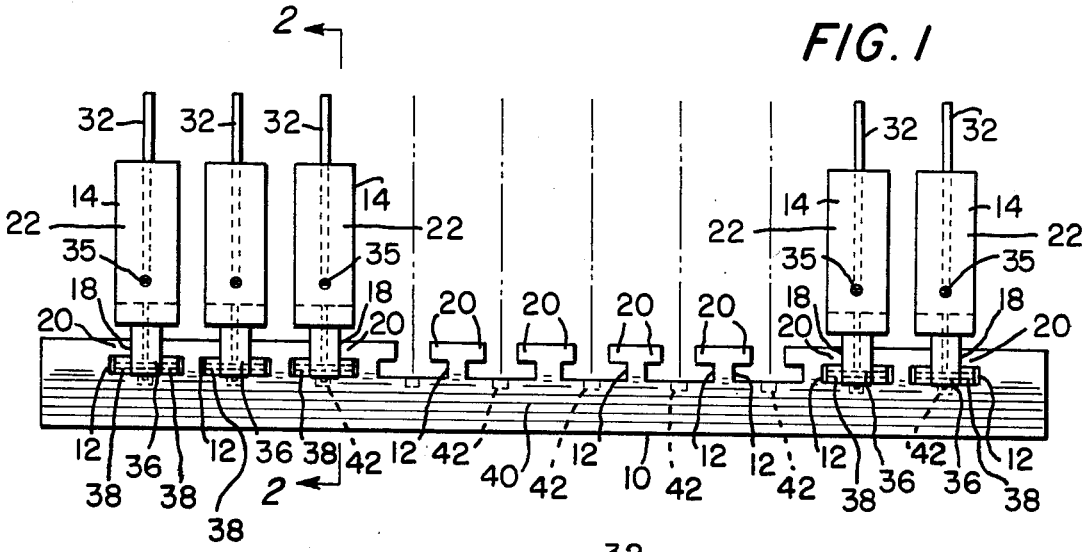
FIG. 1
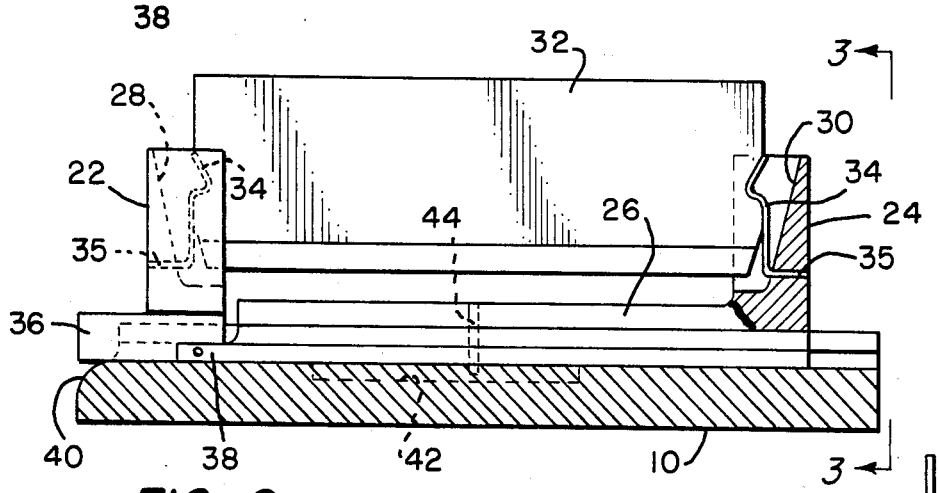
FIG. 2
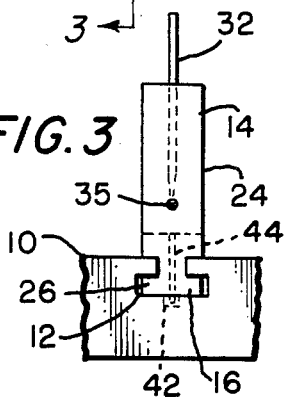
FIG. 3
FIG. 4
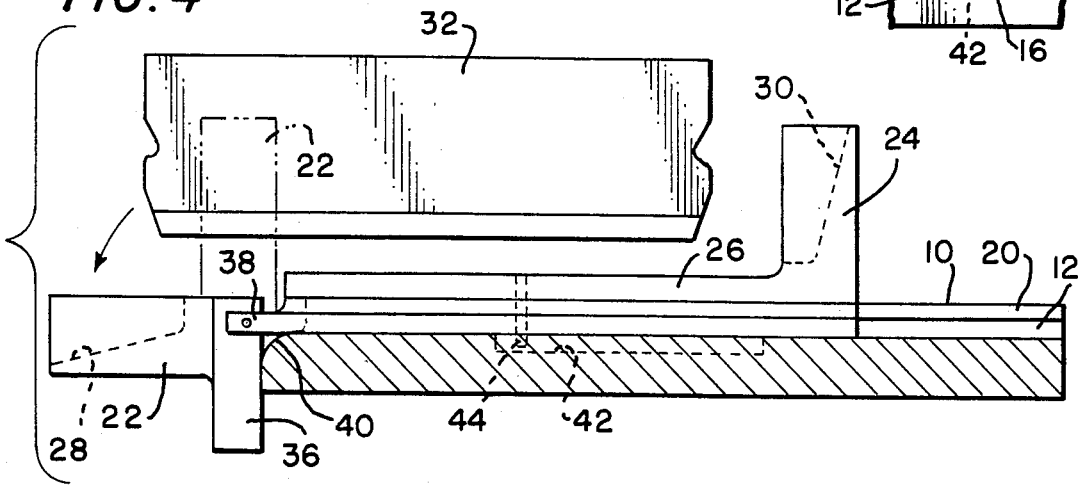

BLADE-HOLDER MAGAZINE

This invention pertains to blade-holders, and in particular to a blade-holder magazine especially configured for use in connection with a stropping mechanism for stropping microtome blades.

What has long been sought in the prior art is a blade-holder magazine in which a plurality of microtome blades can be carried, be readily released for stropping, and as readily be returned to the magazine—all without ever having the blade edge touch anything except the stropping wheels of the stropping mechanism.

It is an object of this invention, then, to set forth just such a blade-holder magazine. Especially is it an object of this invention to disclose a blade-holder magazine comprising a platform; and a plurality of blade carriers; said platform and said carriers having means cooperative for supporting said carriers slidably upon said platform; each of said carriers having means defining a recess in which nestably to receive a blade; wherein said recess-defining means comprises a limb; and said limb comprises means operative for (a) opening said recess, in a first operative mode, to accomodate a release of a blade therefrom, and (b) closing said recess, in a second operative mode, to confine said blade therein.

Further objects of this invention, as well as the novel features thereof, will become more apparent by reference to the following description taken in conjunction with the accompanying figures, in which:

FIG. 1 is a side elevational view of the novel blade-holder magazine according to an embodiment thereof, only some of the blade-carriers (and blades) being shown thereon;

FIG. 2 is a cross-sectional view of the magazine of FIG. 1, the view taken along section 2—2 of FIG. 1;

FIG. 3 is an end elevational view taken along 3—3 of FIG. 2 showing the pivotable mounting of the shoe of the pivotable limb; and FIG. 4 is a view similar to that of FIG. 2 showing, however, the pivotable limb slued over the ramp-side of the platform to release the blade from the limbs-formed recess.

As shown in the figures, the novel magazine, according to an embodiment of the invention, comprises a platform 10 which has a plurality of parallel, inverted-T-shaped keyways 12 formed therein in which slidably to receive blade carriers 14. The blade carriers 14 have complementary inverted-T-shaped keys 16 engaged with the keyways 12. Or, alternatively, it can be said, according to another aspect of the arrangement, each blade carrier 14 has at least one keyway 18 formed therein which receives a key 20 formed in the platform 10.

The blade carriers 14 are slidably engaged with the platform, as noted in the foregoing, to accomodate sidewise movement thereof relative to the platform 10. As viewed in FIG. 2, it can be seen that the carriers 14 (the one shown being typical of each of them) have a pair of parallel limbs 22 and 24 upstanding from a base 26. The limbs 22 and 24 have narrow channels 28 and 30 formed therein; as shown in FIG. 2, the channels 28 and 30, of a generally sloping or tapering configuration, confront each other; together they define a recess in which to receive a blade 32.

Springs 34 are set in the channels 28 and 30; each spring 34, of filamentary form, has an end 35 which penetrates its association limb 24 or 22, and the remainder thereof projects upwardly in the channel 28 or 30. The channel-received portion of each spring 34 has a lobed undulation formed therein for latching engagement with a like relief formed in the blade 32. In this way, the blade 32 is held, resiliently, within the recess formed by the channels 28 and 30 albeit with the blade edge isolated from the base 26 (and all other structures).

It is especially worthy of note that the whole magazine, with the blade carriers 14 engaged with the platform 10, and a complement of blades 3 set in each of the carriers 14, can be fully inverted and none of the blades 32 will come free, and none of the carriers will remove from the platform 10. The springs 34 have sufficient bias to retain the blades 32 in place, yet the latter can be grasped by hand or by some clasping mechanism and relatively effortlessly removed from, and re-inserted into, the carriers.

Limb 24 is integral with the base 26, whereas limb 22 is pivotably coupled thereto. Limb 22 has an underlying shoe 36 an inner portion of which is pivotably pinned to a pair of fingers 38 which project from the base 26. Too, the platform 10, on a side thereof adjacent to such pivotable limbs 22 of the blade carriers 14, has a ramp 40. When a blade carrier 14 is slid to the left (as viewed in FIG. 2), it carries the shoe 36 over the ramp 40 and, due to the offset center of gravity of the limb 22, it slues away to assume the attitude shown in FIG. 4. Now, if the blade 32 is clasped and drawn to the left (as aforesaid), it will slide its carrier 14 in that direction; the clasped and moving blade will send the limb 22 with its shoe 36 over the ramp 40. Thus, the blade-holding recess, formed by the channels 28 and 30 will be opened and the blade 32 will be freed therefrom. If, after having been drawn to the left, on an unwavering line of travel, the blade 32 is returned to the right on such linear travel, it will nest again, properly, with limb 24. Continued motion of the blade 32 to the right, while nested with the limb 24, will cause the base 6 to slide upon the platform 10 and subsequently, again, draw the shoe 36 upon the ramp 40 again. In this latter encounter, the shoe 36 and limb 22 will slue again to bring the latter into an upright parallelism with limb 24. Consequently, the two limbs 22 and 24, again, will have the blade 32 latched therebetween.

The platform 10 has a plurality of travel-limiting slots 42 formed therein, there being one of each under each of the blade carriers 14. Each blade carrier 14, further, has a travel-limiting pin 44 fixed therein and having an end thereof projecting therefrom and slidably engaged with the aforesaid slots 42.

While we have described our invention in connection with a specific embodiment thereof, it is to be clearly understood that this is done only by way of example and not as a limitation to the scope of our invention, as set forth in the objects thereof and in the appended claims.

We claim:

1. A blade-holder magazine, comprising:

a platform; and a plurality of blade carriers;

said platform and said carriers having means cooperative for supporting said carriers slidably upon said platform;

each of said carriers having means defining a recess in which nestably to receive a blade; wherein said recess-defining means comprises a limb; and said limb comprises means operative for (a) opening said recess, in a first operative mode, to accomodate release of a blade therefrom, and (b) closing said recess, in a second operative mode, to confine said blade therein.

2. A blade-holder magazine, according to claim 1, wherein:

said platform has means defining keyways therein; and said blade carriers have means defining keys slidably engaged with said keyways.

3. A blade-holder magazine, according to claim 1, wherein:

said blade carriers have means defining at least one keyway therein; and said platform has means defining at least one key slidably engaged with said at least one keyway of each of said blade carriers.

4. A blade-holder magazine, according to claim 1, wherein:

each of said blade carriers has a base;

said limb is pivotably coupled to said base; and further including a second limb integral with said base.

5. A blade-holder magazine, according to claim 4, wherein:

each of said limbs has a channel formed therein; and said channels are in confronting relationship, upon said pivotably coupled limb being in said second operative mode.

6. A blade-holder magazine, according to claim 5, wherein:

each channel has means therein for latchingly engaging a blade.

7. A blade-holder magazine, according to claim 6, wherein:

said means for latchingly engaging a blade comprises a filamentary spring;

an end of said spring is in penetration of its associated limb, and the remainder of said spring is set within the channel of said associated limb.

8. A blade-holder magazine, according to claim 1, wherein:

said cooperative supporting means comprises means for accomodating movement of said blade carriers, while supported upon said platform, in lateral transverse of said platform.

9. A blade-holder magazine, according to claim 4, wherein:

said blade carriers are supported upon said platform in spaced-apart juxtaposition;

said cooperative suporting means comprises means accomodating movement of said blade carriers sidewise relative to said platform;

said platform has a ramp along one side thereof;

said pivotably-coupled limb has an underlying shoe; and said shoe rides upon said ramp, upon slidable movement of said blade carrier sidewise upon said platform, to transform said pivotably-coupled limb from its first operative mode to its second operative mode.

* * * * *